US006056340A

United States Patent [19]

Kulhavy

[11] Patent Number: 6,056,340

[45] Date of Patent: May 2, 2000

[54] LOAD-HANDLING APPARATUS WITH END EFFECTOR AND CENTER-OF-GRAVITY SHIFTING DEVICE

[75] Inventor: Joseph A. Kulhavy, Southfield, Mich.

[73] Assignee: Ingersoll-Rand Company, Woodcliff Lake, N.J.

[21] Appl. No.: 09/144,040

[22] Filed: Aug. 31, 1998

[51] Int. Cl.[7] ..... B66C 1/22

[52] U.S. Cl. ..... 294/67.21; 294/81.3

[58] Field of Search ..... 294/67.21, 81.3, 294/67.5, 81.4; 414/626; 254/323, 324, 267, 360

[56] References Cited

U.S. PATENT DOCUMENTS

| | | | |
|---|---|---|---|
| 2,494,823 | 1/1950 | Madsen | 294/67.21 |
| 3,680,907 | 8/1972 | Siegwart | 414/626 |
| 4,251,098 | 2/1981 | Belinsky | 294/67.21 |
| 4,262,950 | 4/1981 | Ellingson | 294/67.21 |
| 4,462,571 | 7/1984 | Fox . | |
| 4,478,390 | 10/1984 | Knight et al. . | |
| 4,500,074 | 2/1985 | Fox et al. . | |
| 4,810,016 | 3/1989 | Greenhow | 294/67.21 |
| 4,928,927 | 5/1990 | Fredrick et al. | 254/279 |
| 5,011,364 | 4/1991 | Anderson | 414/694 |
| 5,273,332 | 12/1993 | Currie | 294/67.5 |
| 5,516,255 | 5/1996 | Tygard | 414/626 |
| 5,522,581 | 6/1996 | Kulhavy . | |
| 5,642,979 | 7/1997 | Cullen et al. | 294/67.5 |

FOREIGN PATENT DOCUMENTS

| | | | |
|---|---|---|---|
| 1315378 | 6/1987 | U.S.S.R. | 294/67.21 |
| 1507718 | 9/1989 | U.S.S.R. | 294/67.21 |

*Primary Examiner*—Robert P. Olszewski
*Assistant Examiner*—Paul T. Chin
*Attorney, Agent, or Firm*—Leon Nigohosian, Jr.

[57] ABSTRACT

A center-of-gravity shifting apparatus for attachment to a load-handling apparatus having a bail, a bearing attached to the bail, and a clamping portion for maintaining the bearing in a first position when a weight of a load-handling apparatus is exerted on the bearing. The first position corresponds to a location at which the bail is in line with a center-of-gravity upon lifting a load-handling apparatus. A cam follower connected to the bearing guides the bail from the first position to a second position which corresponds to a location at which the bail is in line with a center-of-gravity of the load-handling apparatus when lifting a load. A load-handling apparatus for lifting and maneuvering a load incorporating the center-of-gravity shifting apparatus, a control handle, and an end effector which includes a pair of forks. The forks may be formed from two U-shaped structures joined into a triangular bracing configuration by a crossbar attached between the forks.

15 Claims, 6 Drawing Sheets

LOAD-HANDLING APPARATUS WITH END EFFECTOR AND CENTER-OF-GRAVITY SHIFTING DEVICE

BACKGROUND OF THE INVENTION

This invention relates to load-handling apparatus and, more particularly, to load-handling apparatus having a lifting bail which automatically locates a lifting force over the center-of-gravity of the load-handling apparatus in the loaded and unloaded states.

Overhead pneumatic balancing hoists are well established as a standard in the materials handling industry in moving loads about a factory or an industrial site. Examples of such balancing hoists and a materials handling system are shown in U.S. Pat. No. 5,522,581, which patent is assigned to the assignee of the instant patent application.

Pallets are also well established in the materials handling industry and have been used to facilitate lifting and moving loads placed onto them about a factory or an industrial site. Typically pallet trucks having a fork-shaped lift device are used to accomplish lifting and moving of pallets. These pallet trucks operate to lift a load by horizontally sliding the forks of the truck, which are in a lowered position, between the upper and lower slats of a pallet prior to raising the forks and with it the pallet.

When attempting to use overhead balancing hoists to lift pallets using fork-shaped end effectors, however, a problem arises in maintaining the end effector at a level attitude before and after loading the pallet onto the end effector. Without a device that changes the balance point to maintain a level attitude of the lift device, the end effector may tilt upon loading with a pallet. As a result the maneuverability of the pallet may be hindered or, worse yet, the pallet may slide off the end effector. Although a pneumatically controlled device with manually operated valves or other manually operated device may be employed to change the maintain a level attitude of the end effector, such devices increase the complexity and cost of solving this problem.

The foregoing illustrates limitations known to exist in present materials handling devices. Thus, it is apparent that it would be advantageous to provide an alternative directed to overcoming one or more of the limitations set forth above. Accordingly, an alternative load-handling apparatus having an end effector and a center-of-gravity shifting device is provided including features more fully disclosed hereinafter.

SUMMARY OF THE INVENTION

In one aspect of the present invention, this is accomplished by providing a center-of-gravity shifting apparatus for attachment to a load-handling apparatus. The center-of-gravity shifting apparatus includes a bail, a bearing attached to the bail, and a clamping portion for maintaining the bearing means in a first position when a weight of a load-handling apparatus is exerted on the bearing. The first position corresponds to a location at which the bail is in line with a center-of-gravity upon lifting a load-handling apparatus. A cam follower connected to the bearing guides the bail from the first position to a second position which corresponds to a location at which the bail is in line with a center-of-gravity of the load-handling apparatus when lifting a load.

In a preferred embodiment, the center-of-gravity shifting apparatus is incorporated into a load-handling apparatus for lifting and maneuvering a load. The load handling apparatus includes a control handle and an end effector which, in yet another embodiment, includes a pair of forks. Preferably the forks are formed from two U-shaped structures joined into a triangular bracing configuration by a crossbar attached between the forks.

It is to be understood that both the foregoing general description and the following detailed description are exemplary, but are not restrictive, of the invention. The foregoing and other aspects will become apparent from the following detailed description when read in conjunction with the accompanying drawing figures.

DETAILED DESCRIPTION OF THE INVENTION

Figure 1:
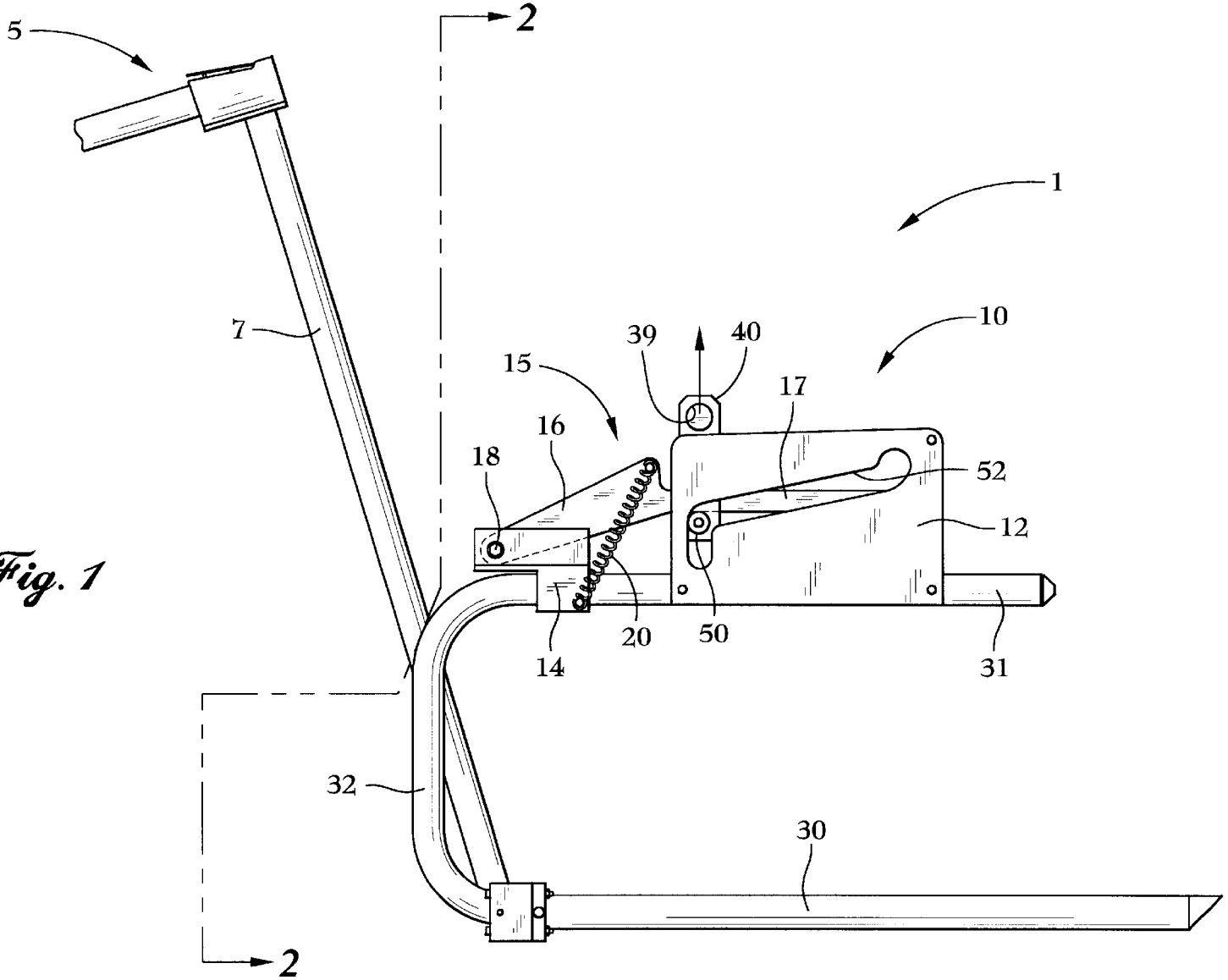
FIG. 1 is a planar side view of an end effector and center-of-gravity shifting device according to the present invention.

The load-handling apparatus having an end effector and center-of-gravity shifting device of the present invention are best understood from the following detailed description when read in connection with the drawing figures in which like reference numerals refer to like elements throughout. It is emphasized that according to common practice, the various dimensions of the apparatus shown in the drawings are not to scale.

Figure 2:
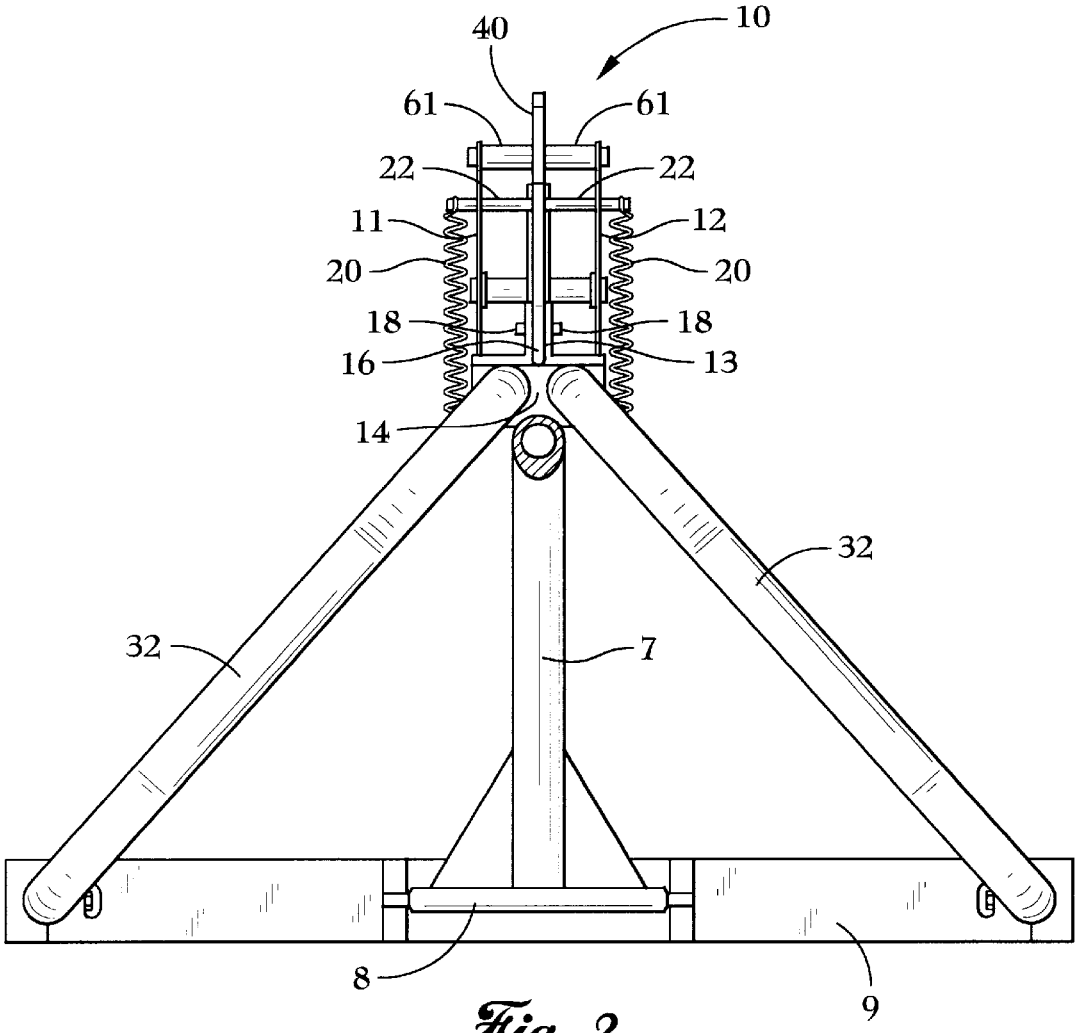
FIG. 2 is a sectional end view of the end effector and center-of-gravity shifting device shown in FIG. 1 taken along the sectional line "2—2" according to the present invention.

Referring now to the drawing, FIG. 1 shows a load-handling apparatus in the form of a pallet handling system 1 which comprises a control handle 5 attached by a column 7 to an end effector having forks 30. Substantially parallel with forks 30 is an upper horizontal portion 31 which, preferably, is made of two tubing portions that are connected to forks 30 by connecting portions 32. Preferably, light-gauge metal or plastic tubing is used to integrally form two U-shape structures each having an integral fork 30, connecting portion 32, and upper horizontal portion 31. As shown in FIG. 2, the U-shaped structures are joined into a triangular bracing configuration by attaching a crossbar 9 between forks 30 and a mounting bracket 14 between the tubing portions of upper horizontal portion 31. Mounting bracket 14 is attached to upper horizontal portion 31 by either a friction fit or by any conventional fastening means. As shown in FIG. 2, mounting bracket 14 also contains a slotted portion 13 into which a pivot portion 16 of a pivot arm 15 is mounted as described in detail below.

Column 7 which, like the U-shaped structures described above is also preferably made of a light-gauge metal or plastic tubing, is pivotally attached to crossbar 9 by a hinge 8 to permit an operator to maintain a grasp of control handle 5 while forks 30 are vertically raised and lowered. Control handle 5 is selected for and operates to control a lifting device (not shown) which is attached to a bail 40 to apply a lifting force represented by the arrow originating at attachment point 39. The lifting device may be selected from any type of overhead lifting device including such devices as a pneumatic overhead lifting hoist.

Figure 3:
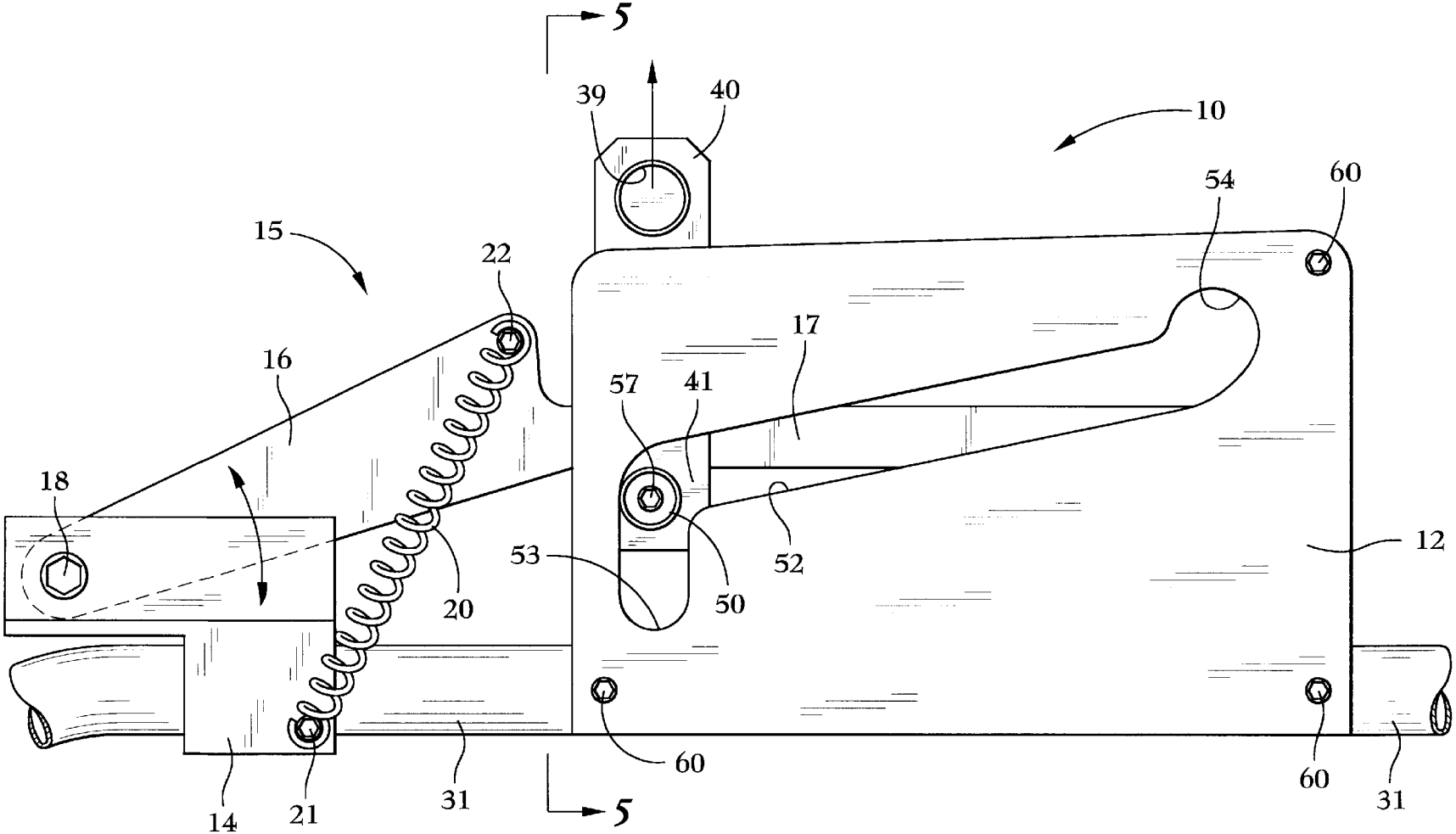
FIG. 3 is an enlarged view of the center-of-gravity shifting device shown in FIG. 1 according to the present invention.
Figure 4:
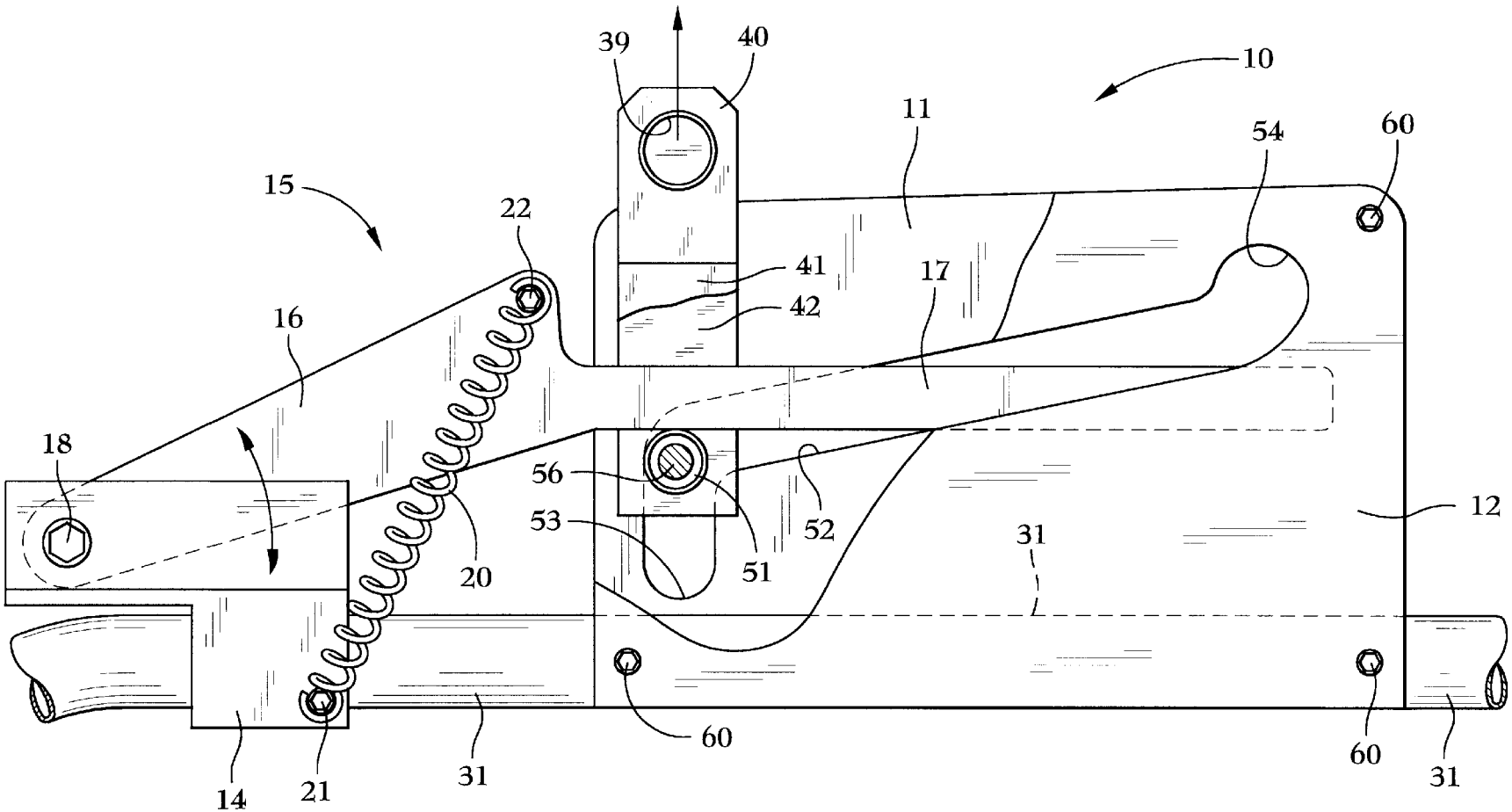
FIG. 4 is sectional view of the center-of-gravity device shown in FIG. 3 according to the present invention.

Shown in FIGS. 3 and 4, are enlarged side and sectional views, respectively, showing the center-of-gravity shifting device 10 in the unloaded state of FIG. 1 in which forks 30 are without a pallet. Shifting device 10 includes two side plates 11 and 12 joined together and mounted to the two tubing portions of upper horizontal portion 31 by bolts 60 and spacers 61, 62, as best illustrated by the sectional end view of FIG. 5. Located through the thickness of each side plates 11 and 12 is a slot which, when side plates 11 and 12 are aligned and joined to one another, define parallel cam surfaces 52 as shown in FIGS. 1, 3, 4, and 6. The slots are each configured so that the parallel cam surfaces 52 have lower detent gate portions 53 and upper detent gate portions 54 which are substantially parallel to a lifting direction of the load-handling apparatus.

Figure 5:
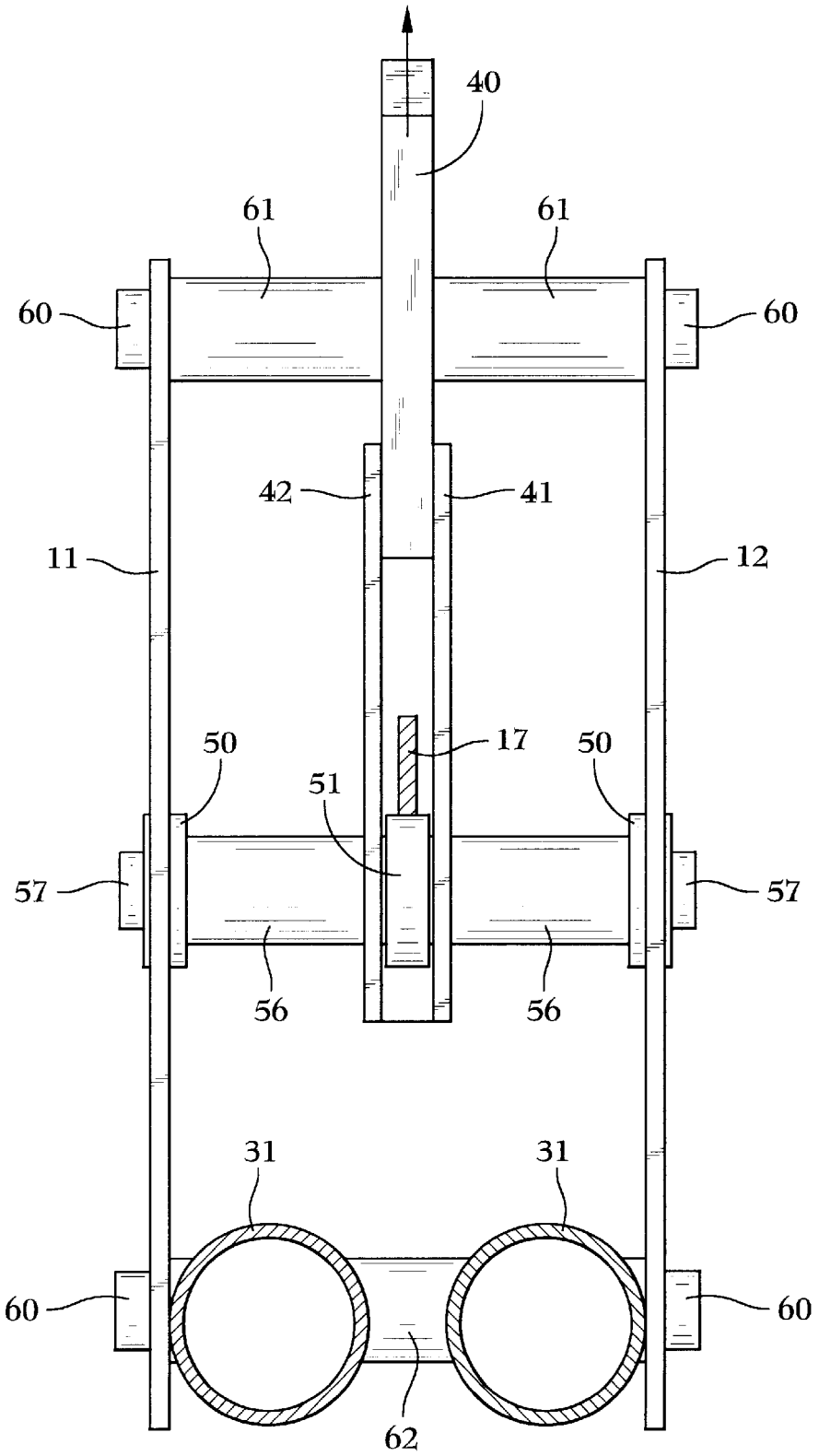
FIG. 5 is a sectional end view of the center-of-gravity shifting device shown in FIG. 3 taken along the line "5—5" according to the present invention.

Shown in FIG. 5 is bail 40 with attached bracket plates 41, 42 between which a bearing 51 is mounted. Spacers 56 and cam followers 50 are mounted between bracket plates 41, 42 and the respective planes of side plates 12, 11 with at least a portion of the cam followers 50 extending into and being located within the slots. Cam followers 50 are attached to spacers 56 by bolts 57 and are in engaging contact with and guided by parallel cam surfaces 52 of side plates 11, 12. In like manner, bearing 51 is in engaging contact with the riding surface of a clamping portion 17 of a pivot arm 15. Bearing 51 and cam followers 50 are coaxially aligned and, preferably, rotatably mounted so that they rollingly engage cam surfaces 52 and the riding surface of clamping portion 17, respectively.

Figure 6:
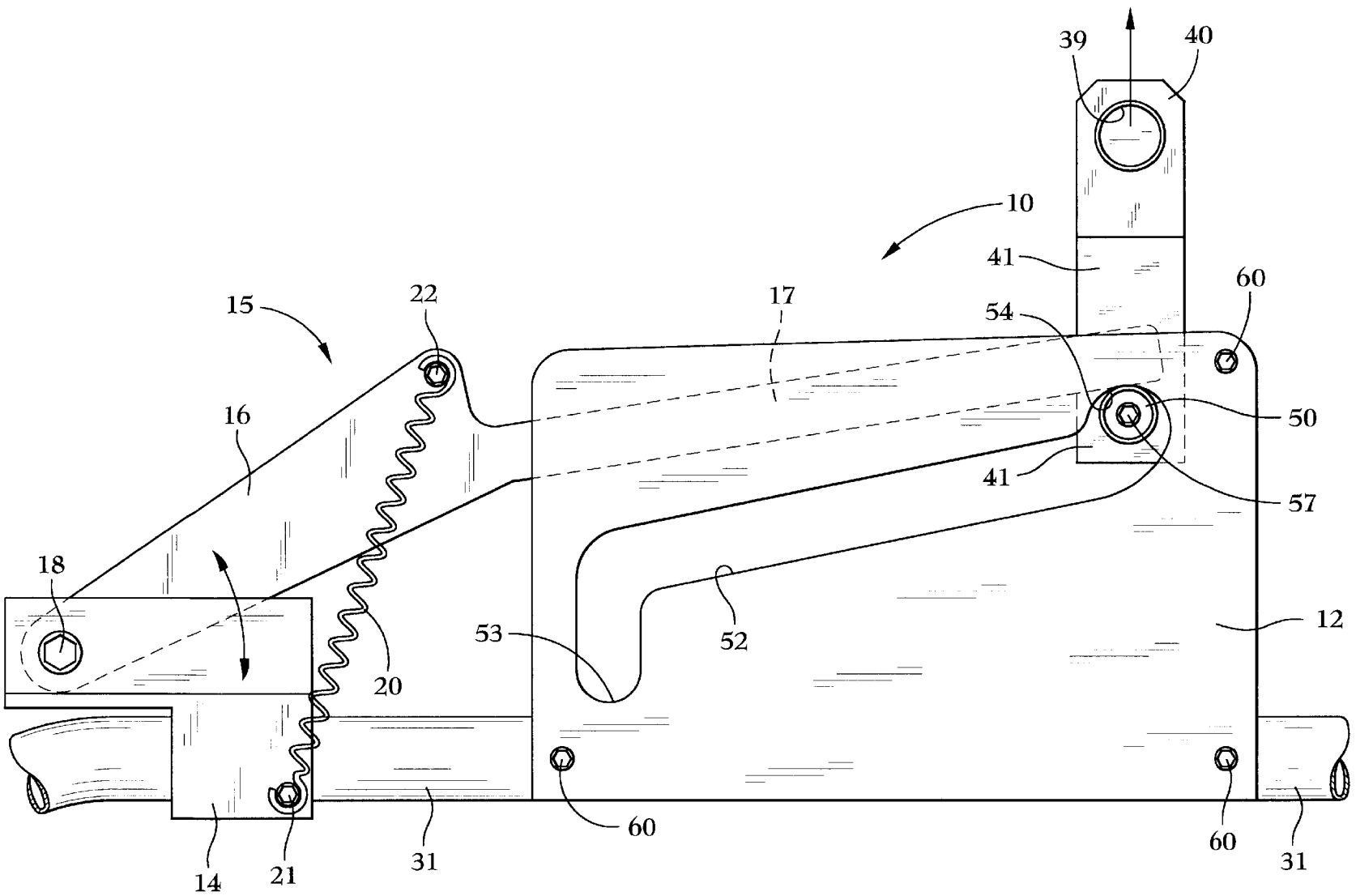
FIG. 6 is the same side view of the center-of-gravity shifting device according to the present invention shown in FIG. 3 disclosing the operating elements thereof in positions different from those shown in FIG. 3.

As best seen in FIGS. 3, 4, and 6, pivot arm 15 includes a pivot portion 16 attached to clamping portion 17. Pivot portion 16 is located in and is pivotally attached to slotted portion 13 of mounting bracket 14 by a pivot 18 as best shown by FIG. 2. Also extending perpendicular to the plane of pivot portion 16 are extension posts 22 that are drawn toward bolts 21 located in mounting bracket 14 by extension springs 20. Extension springs 20 are selected so as to provide a force sufficient to maintain bearing 51 and, in turn, coaxially mounted cam followers 50 in the positions shown in FIGS. 4 and 3, respectively, so that bail 40 remains in the unloaded position as described in greater detail below. Although shown using extension springs 20, it will be readily recognized by those skilled in the art that any alternative tension inducing means, for example, rubber elastic bands, may be used to draw extension posts 22 toward bolts 21.

Operation of the end effector and automatic gravity shifting device according to the present invention will now be described with respect to the enlarged views of FIGS. 4 and 6, showing the center-of-gravity shifting device 10 of FIG. 1 in which forks 30 are, respectively, in the unloaded state without a pallet and the loaded state with a pallet. In lifting loads using a single point lifting bail, by maintaining the location of lifting bail 40 at or substantially in line with the center-of-gravity of the load to be lifted, a level attitude of forks 30 is maintained during lifting. When forks 30 are not loaded with a pallet as shown in FIG. 1, upon applying a lifting force to bail 40 to lift pallet handling system 1, an upward force equal to the weight of the pallet handling system 1 is exerted against clamping portion 17 of pivot arm 15. The tension inducing means (i.e., extension springs 20) is selected or otherwise calibrated to provide a force which pulls pivot portion 16, and with it attached clamping portion 17, downward so as to maintain bearing 51 and attached bail 40 over and in line with the center-of-gravity for the unloaded pallet handling system. The location of center-of-gravity shifting device 10 may be adjusted along the length of upper horizontal portion 31 to adjust the position of bail 40 so that it is in line with the center-of-gravity to accommodate different lifting systems which may be employed.

Pallet handling system 1 is maneuvered into position and lowered so that the forks 30 may be slid in between the slats of a pallet to be lifted. After sliding forks 30 into place, a lifting force is again applied to bail 40 to lift the pallet handling system 1. This lifting force creates an upward force (i.e., a force equal and opposite to the combined weight of the pallet handling system 1 and the pallet) to be exerted by bearing 51 against clamping portion 17 of pivot arm 15. Thus, upon lifting the pallet handling system in the loaded state, the downward force provided by tension inducing means (i.e., extension springs 20) to maintain bearing 51 in position as described above is exceeded by the additional upward force provided by bearing 51 which is required to lift the additional weight of the pallet placed on forks 30. As a result, as shown in FIG. 6 the added weight provided by a pallet causes pivot arm 15 to pivot upward thereby allowing bearing 51 to move up the riding surface of clamping portion 17. This simultaneously permits attached cam followers 50 to exit the lower detent gate portions 53 and ride upward along cam surfaces 52 until they roll up into and come to rest in the upper detent gate portions 54. Along with cam followers 50, bail 40 is also shifted to the location shown in FIG. 6 where it is in line with the new center-of-gravity for the pallet handling system 1 which is loaded with a pallet. As a result of shifting the bail 40 to be in line with the center-of-gravity in the loaded state, the center-of-gravity shifting device 10 according to the present invention permits maneuvering of a pallet while maintaining a level attitude of the forks 30 upon which the pallet is loaded.

With respect to the function of lower detent gate portions 53 and upper detent gate portions 54, these gates prevent cam followers 50 from inadvertently rolling up or down the cam surfaces 52 which could otherwise occur due to a forward or backward pitching of end effector forks 30 caused by the natural movement of the end effector in a production environment.

Although described above with respect to lifting and maneuvering a pallet which does not contain any additional load, it will be readily recognized that the pallet handling system 1 having the center-of-gravity shifting device 10 will also operate to maintain the attitude of a pallet upon which an object to be lifted is placed, provided that the center-of-gravity of the loaded object is substantially centered on the pallet.

Thus, according to the present invention a load-handling apparatus having an end effector and a center-of-gravity shifting device are provided. The center-of-gravity shifting device automatically shifts the point of attachment to the load-handling apparatus so that a vertical line passing through the point of attachment passes through the center-of-gravity of the load-handling apparatus in both the loaded and unloaded states. As a result, the end effector is maintained at a level attitude in both the loaded and unloaded states.

Although illustrated and described herein with reference to certain specific embodiments of a load-handling apparatus, namely, a pallet handling system, the present invention is nevertheless not intended to be limited to the details shown. Rather, it will be readily understood based on and upon reading the teachings of this disclosure, that other various modifications may be made in the details in the scope and range of equivalents of the claims without departing from the spirit of the invention. Such modifications may include the incorporation of the gravity shifting device disclosed herein into any lifting device in which the point of attachment for a lifting force is to be automatically repositioned in line with a center-of-gravity which has shifted due to a change in the load which is being lifted.

Furthermore, it is to be understood that the particular construction shown is not to be limiting. For example, although side plates 11, 12 are shown joined together to upper horizontal portion 31 by bolts 60 and spacers 61, 62, it will be readily recognized that any suitable fastening means may be employed as is known in the art provided the range of motion of bail 40 as described above is not hindered. Moreover, although shown having two tubing portions, upper horizontal portion 31 may comprise only a single tube. Additionally, although shown using extension springs 20, it will be readily recognized by those skilled in the art that other alternative tension inducing means, for example, rubber elastic bands, may be used to draw extension posts 22 toward bolts 21.

What is claimed is:

1. A center-of-gravity shifting apparatus for attachment to a load-handling apparatus, comprising:

a bail;

bearing means attached to said bail;

clamping means for maintaining said bearing means in a first position when a weight of a load-handling apparatus is exerted on said bearing means;

cam means connected to said bearing for guiding said bail from said first position to a second positing, said cam means comprising cam followers coaxially aligned and mounted with said bearing;

said first position corresponding to a location at which said bail is in line with a center-of-gravity upon lifting said load-handling apparatus; and said second position corresponding to a location at which said bail is in line with a center-of-gravity of said load-handling apparatus when lifting a load; and a pair of parallel side plates between which are located said bearing means and said clamping means, said side plates having slots which define parallel cam surfaces which engage and guide said cam means.

2. The center-of-gravity shifting apparatus as recited by claim 1, wherein said bail further comprises bracket plates between which said bearing is mounted.

3. The center-of-gravity shifting apparatus as recited by claim 1, wherein said cam followers and said bearing are rotatably mounted.

4. The center-of-gravity shifting apparatus as recited by claim 1, wherein said slots each comprise upper and lower detent portions which are substantially vertical to a lifting direction of said load-handling apparatus.

5. A center-of-gravity shifting apparatus for attachment to a load-handling apparatus, comprising:

a bail;

bearing means attached to said bail;

clamping means for maintaining said bearing means in a first position when a weight of a load-handling apparatus is exerted on said bearing means;

cam means connected to said bearing for guiding said bail from said first position to a second position;

said first position corresponding to a location at which said bail is in line with a center-of-gravity upon lifting said load-handling apparatus; and said second position corresponding to a location at which said bail is in line with a center-of-gravity of said load-handling apparatus when lifting a load; and a tension inducing means which applies force to said clamping means to maintain said bearing means in said first position.

6. A load-handling apparatus for lifting and maneuvering a load, comprising:

a control handle;

an end effector having a pair of forks;

an upper horizontal portion parallel to and connected to said pair of forks by vertical connecting portions with each of said forks being integrally formed with said upper horizontal portion and said vertical connecting portions to form two U-shaped structures;

a center-of-gravity shifting means having a bail;

bearing means attached to said bail;

clamping means for maintaining said bearing means in a first position when a weight of a load-handling apparatus is exerted on said bearing means;

cam means connected to said bearing for guiding said bail from said first position to a second position;

said first position corresponding to a location at which said bail is in line with a center-of-gravity upon lifting said load-handling apparatus; and said second position corresponding to a location at which said bail is in line with a center-of-gravity of said load-handling apparatus when lifting a load.

7. The load handling apparatus as recited by claim 6, further comprising a tension inducing means which applies force to said clamping means to maintain said bearing means in said first position.

8. The load-handling apparatus as recited by claim 6, wherein said U-shaped structures are made of tubing.

9. The load-handling apparatus as recited by claim 8, wherein said tubing is made from a material selected from the group consisting of a light-gauge metal or plastic.

10. The load-handling apparatus as recited by claim 6, wherein said U-shaped structures are joined into a triangular bracing configuration by a crossbar attached between said forks and a mounting bracket attached to said upper horizontal portion.

11. The load-handling apparatus as recited by claim 10, wherein said end effector is connected to said control handle by a column, said column being pivotally attached to said crossbar by a hinge.

12. The load-handling apparatus as recited by claim 6, wherein said center-of-gravity shifting means is attached to said upper horizontal portion.

13. A load-handling apparatus for lifting and maneuvering a load, comprising:

a control handle;

an end effector having a pair of forks;

an upper horizontal portion parallel to said pair of forks;

a mounting bracket attached to said upper horizontal portion;

a center-of-gravity shifting means having a bail;

bearing means attached to said bail;

clamping means for maintaining said bearing means in a first position when a weight of a load-handling apparatus is exerted on said bearing means;

cam means connected to said bearing for guiding said bail from said first position to a second position;

said first position corresponding to a location at which said bail is in line with a center-of-gravity upon lifting said load-handling apparatus; and said second position corresponding to a location at which said bail is in line with a center-of-gravity of said load-handling apparatus when lifting a load.

14. The load-handling apparatus as recited by claim 13, wherein said clamping means is a clamping portion of a pivot arm having a pivot portion attached to said clamping portion, said pivot portion being located in and pivotally attached to a slotted portion of said mounting bracket.

15. The load-handling apparatus as recited by claim 14, further comprising extension posts extending perpendicular to a plane of said pivot portion and a tension inducing means attached between said extension posts and said mounting bracket.

* * * * *